United States Patent [19]

Stephens

[11] 3,966,430

[45] June 29, 1976

[54] CARBURETOR ADAPTER

[76] Inventor: Woodrow W. Stephens, 2704 S. Mulberry St., Muncie, Ind. 47302

[22] Filed: July 10, 1975

[21] Appl. No.: 595,325

[52] U.S. Cl. ..... 48/180 R; 123/141

[51] Int. Cl.[2] ..... F02M 29/04

[58] Field of Search ..... 48/180 R; 123/141

[56] References Cited

UNITED STATES PATENTS

| | | | |
|---|---|---|---|
| 1,061,655 | 5/1913 | Bachman | 123/141 |
| 1,471,704 | 10/1923 | Palizza | 48/180 R |
| 3,414,242 | 12/1968 | Bouteleux | 261/18 R |

FOREIGN PATENTS OR APPLICATIONS

| | | | |
|---|---|---|---|
| 512,997 | 10/1920 | France | 48/180 R |
| 480,634 | 3/1953 | Italy | 48/180 R |
| 764,826 | 10/1957 | United Kingdom | 48/180 R |

*Primary Examiner*—Tim R. Miles
*Attorney, Agent, or Firm*—Woodard, Weikart, Emhardt & Naughton

[57] ABSTRACT

Disclosed is an attachment for insertion between the carburetor and intake manifold or firing chamber of an internal combustion engine which utilizes one or more solid conical members, having a series of axial and semi-radially directed apertures through which the gas-air mixture leaving the carburetor is forced thereby increasing the turbulence and homogenization of the air-gas mixture before it is introduced into the engine.

3 Claims, 3 Drawing Figures

CARBURETOR ADAPTER

BACKGROUND OF THE INVENTION

Improved homogenization of the air-gas mixture leaving the carburetor results in improved horsepower capability for the engine and decreased polluting exhaust emission because of the more complete combustion of the more homogenous mixture. A prior art device for accomplishing this result is disclosed in Bouteleux U.S. Pat. No. 3,414,242.

The apparatus of the present invention represents an improvement over the prior art devices in that the conical members, through which the turbulence-producing jets or apertures are drilled, are formed as a solid block of metal and are thus, because of the inherent thermal lag in the blocks, generally impervious to short term temperature fluctuations. The attachment of the present invention is also characterized by the absence of auxiliary air intake ports to the conical members, all of the air intake to the attachment coming from the carburetor.

DESCRIPTION OF THE PREFERRED EMBODIMENT

Figure 1:
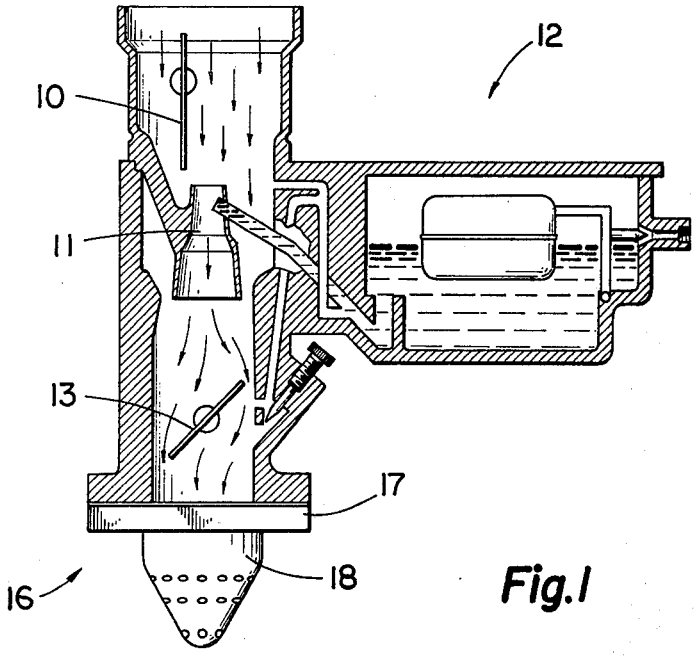
FIG. 1 is a side sectional, schematic view of the apparatus of the present invention installed on a carburetor.

Referring initially to FIG. 1, there is disclosed, schematically, a conventional carburetor for an internal combustion engine having a choke 10, a venturi 11, a float chamber and float 12 and a throttle valve 13. It will be understood that the carburetor is conventional and the apparatus of the present invention, indicated generally at 16 is attached to the base flange of the carburetor, interposed between the carburetor and the intake manifold or firing chamber of the engine (not shown) on which the carburetor is mounted. In FIG. 1 a single barrel carburetor is shown and the apparatus 16 of the present invention has depending from its base 17 a single apertured conical member 18. In the apparatus shown in FIGS. 2 and 3, to be described in detail, a form of the adapter or apparatus of the present invention is shown utilizing dual, identical conical members, the apparatus thus being adapted for use with a conventional two barrel carburetor which is shown schematically at 21 in FIG. 2.

Figure 2:
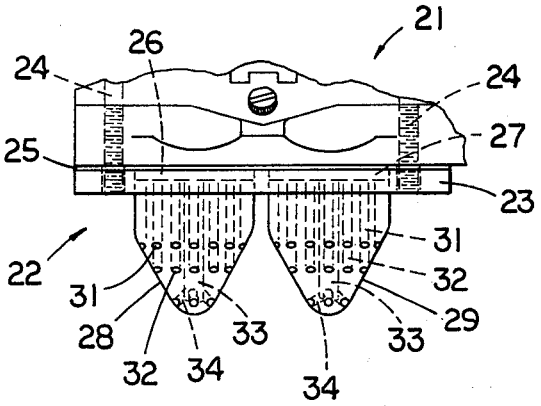
FIG. 2 is a side view of the apparatus of the present invention shown installed on a carburetor, the carburetor being shown fragmentarily only.

In FIG. 2 the apparatus of the present invention is indicated generally at 22 and includes a generally flat base 23 which is provided with mounting holes which register with the carburetor mounting holes and which is held in underlying relation to the mounting flange of the carburetor by means of machine screws 24. A gasket 26 may be interposed between the carburetor flange and the base 23 of the adapter to maintain the seal between these two abutting surfaces.

Figure 3:
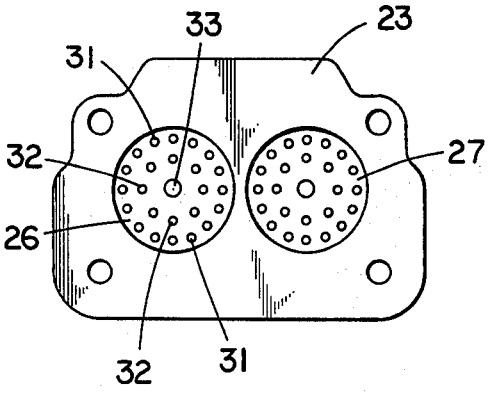
FIG. 3 is a top plan view of the apparatus of the present invention.

As may be seen in FIGS. 2 and 3 the base 23 is undercut to provide two identical chambers 26 and 27 the chambers registering with the outlet passages of the two barrels of the carburetor 21. Depending from the lower face of the base 23 are generally conically shaped members 28 and 29. The conical members are formed of solid blocks of metal which may be integral with the base 23 or may be blocks inserted into the base 23. A first series of spaced apertures, circularly arranged in a concentric pattern are identified at 31, the inwardly spaced circularly arranged series of apertures being identified at 32. It will be evident from FIG. 2, the passages provided by the apertures extend parallel to the axis of the conical members and terminate at the inclined outer face of the members.

A central aperture 33 of larger diameter extends to each of the conical members coincident with the axis of the respective conical member. The apertures 33, however do not extend through the conical member but extend adjacent to, but not through, the apex area of the members. Intersecting the central aperture 33 and extending to the exterior surface of the cone shaped members is a further series of spaced apertures 34. These apertures extend generally radially outwardly at an angle of, preferably, approximately 50° with the axis of the cone shaped members.

With the adapter installed on a carburetor as shown in FIG. 2, with the conical members 28 and 29 extending into the intake manifold or firing chambers of the engine served by the carburetor, the gas and air mixture issuing from the carburetor will be forced, by the air flow, into the chamber 26 and 27 and through the apertures 31–34. Forcing of the gas air mixture through the apertures produces a turbulence in the mixture which serves to more completely mix or homogenize the mixture. No auxiliary air inlets are used with the adapter, all of the air coming from the carburetor with the atomized gasoline. While operation of the device is not totally dependent on the number or sizes of jets or apertures in the conical members, a total of 2240 apertures has proven to be satisfactory.

While the invention has been disclosed and described in some detail in the drawings and foregoing description, they are to be considered as illustrative and not restrictive in character, as other modifications within the scope of the invention may readily suggest themselves to persons skilled in the art.

I claim:

1. An apparatus adapted for insertion between the carburetor and the intake manifold of an internal combustion engine, said apparatus comprising a generally flat base and at least one solid conical member depending from one face of the base, the other face of the base being undercut in register with the depending conical member, a series of spaced apertures extending through said conical member parallel to the axis of the member, a central aperture of larger diameter than said first mentioned spaced apertures coincident with the axis of the conical member and extending adjacent to but not through the apex of said conical member, and a further series of spaced apertures extending to the exterior of the cone shaped member from said central aperture, said further series of spaced apertures being adjacent the apex of said cone shaped member and extending at an acute angle with the axis of the cone shaped member.

2. An apparatus as claimed in claim 1 in which said base has depending from it two identically apertured conical members thereby adapting the apparatus for use with a two barrel carburetor.

3. An apparatus as claimed in claim 1 in which the acute angle of extension of said further series of apertures is approximately 50°.

* * * * *